US009470216B2

(12) United States Patent
Reeves et al.

(10) Patent No.: US 9,470,216 B2
(45) Date of Patent: Oct. 18, 2016

(54) METHOD FOR REDUCING PERMEABILITY OF DOWNHOLE MOTOR PROTECTOR BAGS

(71) Applicant: GE Oil & Gas ESP, Inc., Oklahoma City, OK (US)

(72) Inventors: Brian Reeves, Edmond, OK (US); Chengbao Wang, Oklahoma City, OK (US); Steven Alan Howell, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 0 days.

(21) Appl. No.: 14/135,366

(22) Filed: Dec. 19, 2013

(65) Prior Publication Data

US 2014/0147307 A1 May 29, 2014

Related U.S. Application Data

(63) Continuation-in-part of application No. 13/687,862, filed on Nov. 28, 2012, now abandoned.

(51) Int. Cl.

| | |
|---|---|
| ***F04B 47/00*** | (2006.01) |
| ***F04B 17/03*** | (2006.01) |
| ***F04B 47/06*** | (2006.01) |
| ***F04B 53/16*** | (2006.01) |

(52) U.S. Cl.

CPC ..... *F04B 17/03* (2013.01); *F04B 47/06* (2013.01); *F04B 53/16* (2013.01)

(58) Field of Classification Search

CPC ..... F04B 47/06; F04B 17/03; F04B 53/16; B32B 37/1284; B32B 2255/205; B32B 15/043; B32B 2038/0092; B32B 2255/06; B32B 2264/105; B32B 2311/24; B32B 2367/00; B32B 23/08; B32B 2255/00; B32B 2327/06; B32B 9/045; B32B 17/10174; B29C 63/00; B29C 63/0065; B29C 65/002; B29C 65/02; Y10T 156/1002; Y10T 156/1007; E21B 33/12; E21B 43/12; E21B 43/126; E21B 43/128; E21B 43/129

See application file for complete search history.

(56) References Cited

U.S. PATENT DOCUMENTS

| | | | | |
|---|---|---|---|---|
| 3,567,546 | A | 3/1971 | Morris et al. | |
| 4,837,068 | A * | 6/1989 | Martin | C23C 14/205 428/133 |
| 6,100,616 | A * | 8/2000 | Heinig | E21B 41/00 310/112 |
| 8,246,326 | B2 | 8/2012 | Royzen | |
| 2011/0194956 | A1 * | 8/2011 | Royzen | E21B 33/1277 417/414 |

FOREIGN PATENT DOCUMENTS

| | | |
|---|---|---|
| EP | 0327844 A2 | 8/1989 |

OTHER PUBLICATIONS

PCT Search Report and Written Opinion issued in connection with corresponding PCT Application No. PCT/US2014/069713 on Feb. 19, 2015.

* cited by examiner

*Primary Examiner* — Jacob T Minskey
*Assistant Examiner* — Vishal I Patel
(74) *Attorney, Agent, or Firm* — Crowe & Dunlevy, P.C.

(57) ABSTRACT

A method for applying a metalized polymer film to a seal bag for use in a downhole submersible pumping system includes the steps of applying a metal layer to a polymer layer, applying an adhesive layer to the polymer layer, and rolling the adhesive layer onto a substrate of the seal bag. The method may also include the steps of rotating a first roller, which is located above the polymer layer of the metalized polymer film, and rotating a second roller, which is located on an interior surface of the substrate of the seal bag, in the opposite direction of the first roller. Also disclosed is a downhole pumping system that incorporates a seal bag manufactured from these techniques.

16 Claims, 5 Drawing Sheets

METHOD FOR REDUCING PERMEABILITY OF DOWNHOLE MOTOR PROTECTOR BAGS

RELATED APPLICATIONS

The present application is a continuation-in-part of U.S. patent application Ser. No. 13/687,862, filed Nov. 28, 2012, entitled "Metalized Polymer Components for Use in High Temperature Pumping Applications," the disclosure of which is incorporated herein.

FIELD OF THE INVENTION

This invention relates generally to the field of submersible pumping systems, and more particularly, but not by way of limitation, to a method for reducing the permeability of a seal bag within a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system must be engineered to withstand the inhospitable downhole environment, which includes wide ranges of temperature, pressure and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, protecting the motor from axial thrust imparted by the pump, and accommodating the expansion and contraction of motor lubricant as the motor moves through thermal cycles during operation. Many seal sections employ seal bags to accommodate the volumetric changes and movement of fluid in the seal section.

As the use of downhole pumping systems extends to new applications, traditional seal bags may not be suitable. For example, the use of downhole pumping systems in combination with steam assisted gravity drainage (SAGD) technology exposes seal bag components to temperature in excess of 500° F. Of particular concern is the potential for liquid water permeation through the seal bags at these extreme temperatures. In particular, water ingress into the electric motor can affect the preferred properties of the motor, such as favorable lubrication, dielectric and chemical compatibility. To increase the resistance of the seal bag to degradation under these increasingly hostile environments, manufacturers have employed durable polymers, including various forms of polytetrafluoroethylene (PTFE), as the preferred material of construction. More recently, extruded perfluoroalkoxy (PFA) fluoropolymers tubing has become a material of choice for seal bags. The use of PFA as the material of construction in seal bags is disclosed in U.S. Pat. No. 8,246,326 issued Aug. 21, 2012 and assigned to GE Oil & Gas ESP, Inc.

Although generally effective, PFA and many other elastomeric and polymeric materials are nonetheless susceptible to water ingress due to transmission by permeation or diffusion through the material at extremely high temperatures. There is, therefore, a need for a method of further reducing the permeability of the seal bag, seal sections and submersible pumping systems. It is to this and other needs that the present invention is directed.

SUMMARY OF THE INVENTION

In a preferred embodiment, the present invention provides a method for applying a metalized polymer coating to the substrate of a PFA material of a seal bag for use in a downhole submersible pumping system. The method includes the steps of applying a metal layer to a polymer layer, applying an adhesive layer to the polymer layer or the metal layer, and rolling the adhesive layer onto a substrate of the seal bag. The method may also include the steps of rotating a first roller, which is located above the polymer layer of the metalized polymer film, and rotating a second roller, which is located on an interior surface of the substrate of the seal bag, in the opposite direction of the first roller. Heat or pressure can be used to assist in the adherence of the metalized polymer coating to the substrate of the seal bag. The polymer layer of the metalized polymer coating preferably comprises a PTFE polymer.

DETAILED DESCRIPTION OF THE PREFERRED EMBODIMENTS

Figure 1:
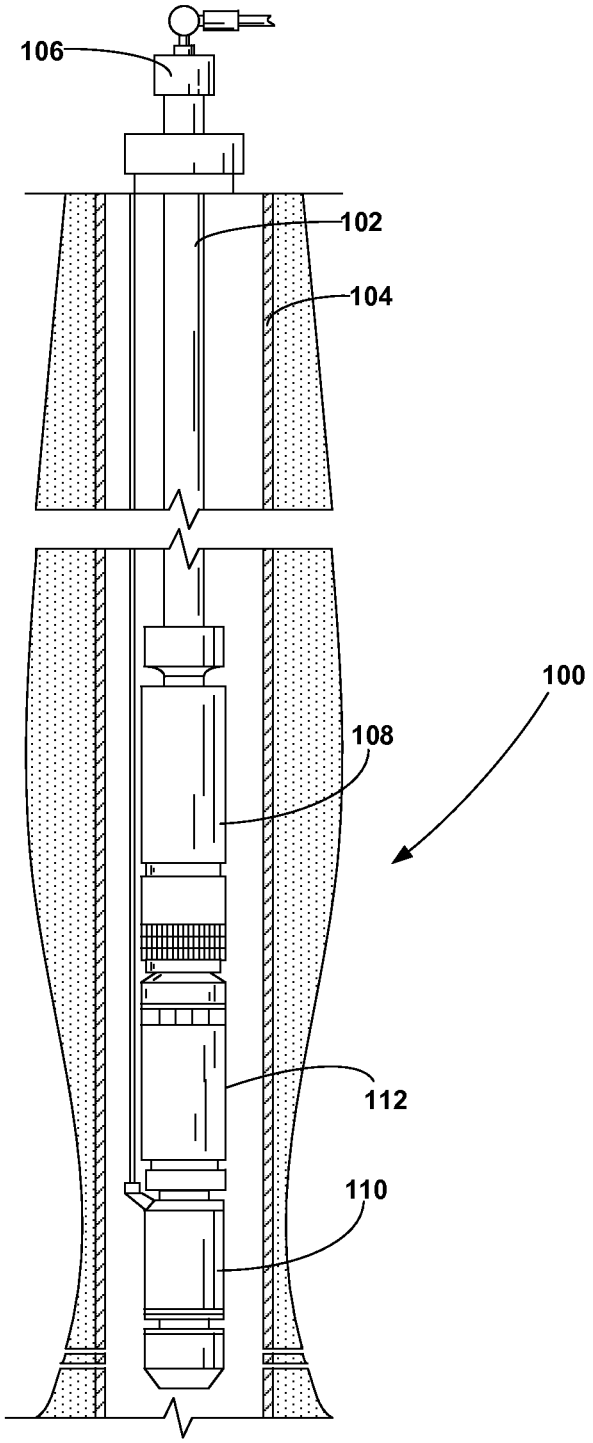
FIG. 1 is an elevational view of a submersible pumping system constructed in accordance with a presently preferred embodiment.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 preferably includes some combination of a pump assembly 108, a motor assembly 110 and a seal section 112. The motor assembly 110 is preferably an electrical motor that receives power from a surface-mounted motor control unit (not shown). When energized, the motor assembly 110 drives a shaft that causes the pump assembly 108 to operate. The seal section 112 shields the motor assembly 110 from mechanical thrust produced by the pump assembly 108 and provides for the expansion of motor lubricants during operation. The seal section 112 also isolates the motor assembly 110 from the wellbore fluids passing through the pump assembly 108. Although only one of each component is shown, it will be understood that more can be connected when appropriate. It may be desirable to use tandem-motor combinations, multiple seal sections, multiple pump assemblies or other downhole components not shown in FIG. 1.

Figure 2:
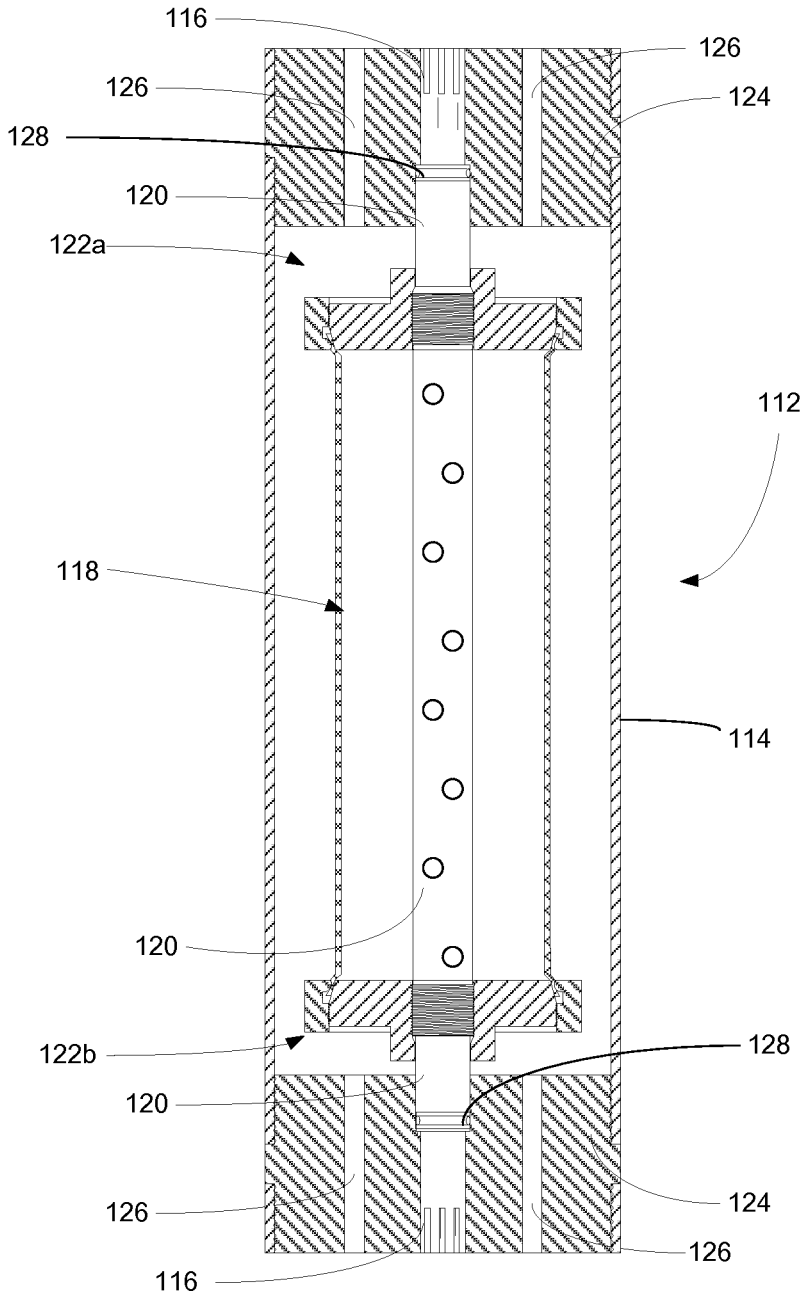
FIG. 2 is a cross-sectional view of a first preferred embodiment of a seal section for use with the submersible pumping system of FIG. 1.

Referring now to FIG. 2, shown therein is a cross-sectional view of the seal section 112. The seal section 112 includes a housing 114, a shaft 116, a seal bag 118, a support tube 120 and first and second bag plates 122*a*, 122*b*. The seal bag 118 is configured to prevent the contamination of clean motor lubricants with wellbore fluids. The shaft 116 transfers mechanical energy from the motor assembly 110 to the pump assembly 108. The bag support tube 120 provides support for the seal bag 118 and shields the shaft 116 as its passes through the seal bag 118. For the purposes of the instant disclosure, the terms "bag seal assembly" will refer to the seal bag 118, the bag support tube 120 and the first and second bag plates 122*a*, 122*b*. In addition to the bag seal assembly, the seal section 112 may also include seal guides 124, a plurality of ports 126 and one or more o-ring seals 128. The o-ring seals 128 are located at various positions within the seal section 112 and limit the migration of contaminants and well fluids into the clean lubricant.

For purposes of illustration, the bag seal assembly is disclosed as contained within the seal section 112. It will be understood, however, that the bag seal assembly could be installed elsewhere in the pumping system 100. For example, it may be desirable to integrate the bag seal assembly within the motor assembly 110 or pump assembly 108.

Figure 3:
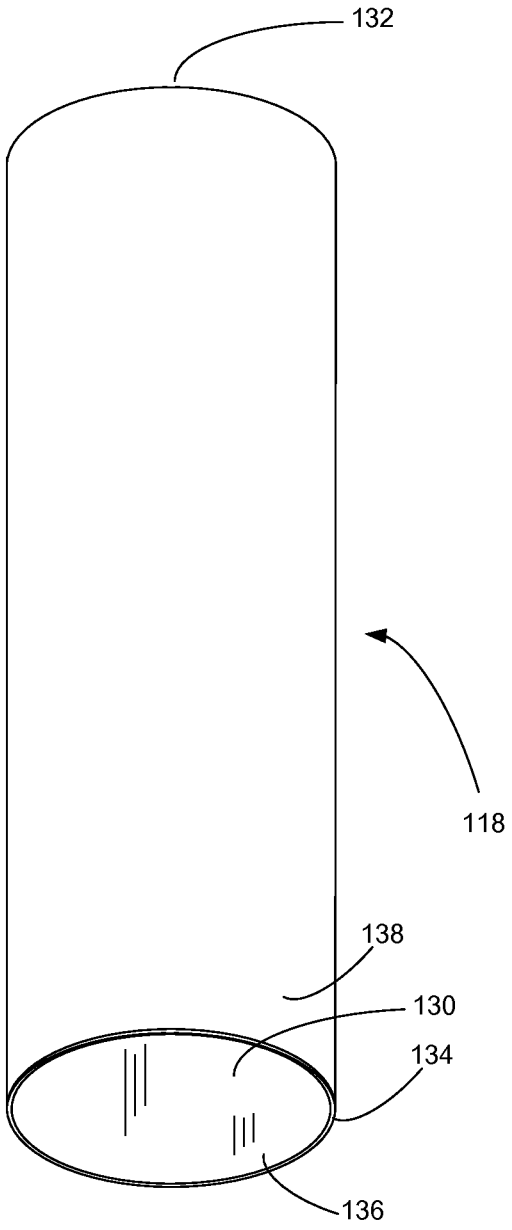
FIG. 3 is a perspective view of a first preferred embodiment of the seal bag of FIG. 2.

Referring now also to FIG. 3, shown therein is a side perspective view of a preferred embodiment of the seal bag 118. The seal bag 118 preferably includes a substrate 130, a first end 132 and a second end 134. In preferred embodiments, the substrate 130 is substantially configured as an elongated cylinder with an interior surface 136 and an exterior surface 138. In preferred embodiments, the substrate 130 is fabricated from an elastomer or other polymer, such as, for example PTFE, PFA, or polyvinyl chloride (PVC). In particularly preferred embodiments, the substrate 130 is constructed from extruded PFA.

Figure 4:
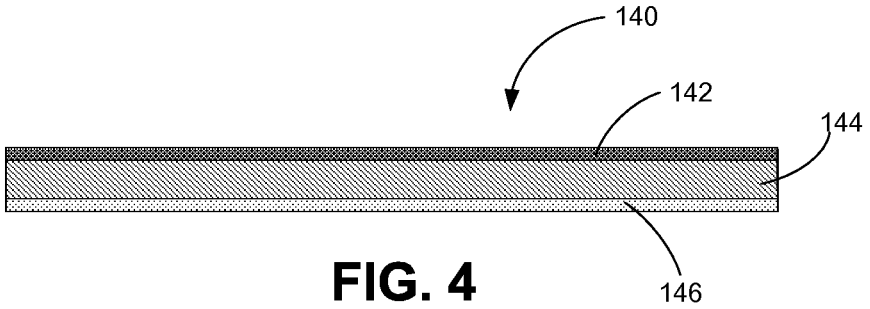
FIG. 4 is a cross-sectional view of a substrate constructed in accordance with a presently preferred embodiment.

Turning now to FIG. 4, shown therein is a close-up, cross sectional view of a preferred embodiment of a metalized polymer film 140. The metalized polymer film 140 includes a metal coating layer 142, a polymer film layer 144 and an adhesive layer 146. Presently preferred metals to be used in the metal coating layer 142 include titanium, stainless steel, nickel, aluminum, chrome, silver and gold, and alloys for each of these metals. It will be appreciated that the metal coating layer 142 may be produced with combinations of multiple metals and metal alloys. It will also be understood that in alternate preferred embodiments, the metal coating layer 142 may consist of multilayered coatings with two or more metal coating layers 142 and that each metal coating layer 142 may be prepared using different metals and metal alloys. In preferred embodiments, the metal coating layer 142 constitutes a metal foil that is suitable for adherence to adjacent layers of the polymer film layer 144. In alternate embodiments, the metal coating layer includes a metal deposition layer applied to a substrate. The deposition layer may be achieved through sputtering and vacuum metallization.

The polymer film layer 144 is fabricated from an elastomer or other polymer, such as, for example PTFE, PFA, or PVC. In preferred embodiments, the polymer film layer 144 is fabricated from PTFE with a thickness of 0.001 inches to 0.005 inches. Presently preferred adhesives utilized as the adhesive layer 146 include heat sensitive or pressure sensitive adhesives, and may consist of any known adhesives suitable in such applications, such as silicones, epoxies, polyurethanes, acrylics, and polyimides. Although the metalized polymer film 140 is depicted so that the adhesive layer 146 is joined to the polymer film layer 144, it will be understood that in alternate preferred embodiments, the adhesive layer 146 may be joined to the metal coating layer 142.

Figure 5:
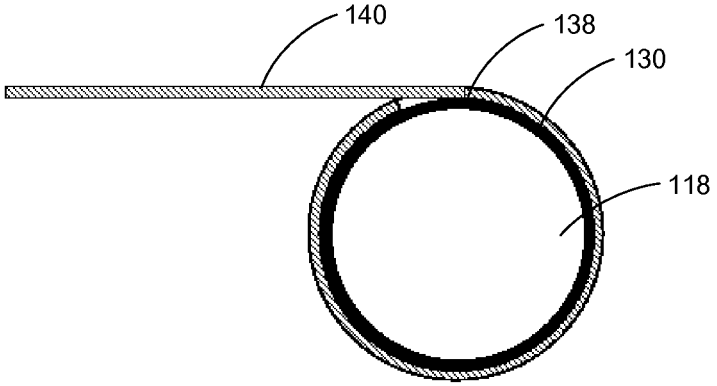
FIG. 5 is a cross-sectional view of the substrate of FIG. 4 being applied to the seal bag of FIG. 3 in accordance with a presently preferred embodiment.

Now referring to FIG. 5, shown therein is a cross sectional view of the metalized polymer film 140 being applied to the substrate 130 of the seal bag 118. In a preferred embodiment, the metalized polymer film 140 is applied to the seal bag 118 by rolling the seal bag 118 about its axis and applying the metalized polymer film 140 so that the adhesive layer 146 is in contact with the exterior surface 138 of the substrate 130 of the seal bag 118. In particularly preferred embodiments, the metalized polymer film 140 is wrapped around the seal bag 118 a number of times to create several overlapping layers of metalized polymer film 140 around the seal bag 118.

Figure 6:
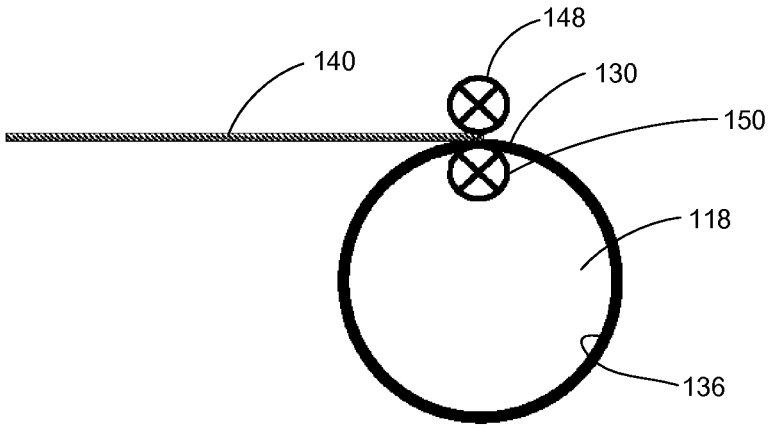
FIG. 6 is a cross-sectional view of a second alternative version of the substrate of FIG. 4 being applied to the seal bag of FIG. 3.

As shown in FIG. 6, in a cross sectional view of an alternate preferred embodiment, the metalized polymer film 140 is applied to the substrate 130 of the seal bag 118 by rolling the metalized polymer film 140 and the seal bag 118 between a first mandrel 148 positioned above the metalized polymer film 140 and a second mandrel 150 positioned on the interior surface 136 of the seal bag 118. The first mandrel 148 rotates in one direction and the second mandrel 150 rotates in the opposite direction to move the metalized polymer film 140 and the substrate 130 of the seal bag 118 between the first mandrel 148 and the second mandrel 150.

The first mandrel 148 and the second mandrel 150 can alternatively be used to apply the requisite pressure if a pressure sensitive adhesive is used for the adhesive layer 146 of the metalized polymer film 140. In an alternative preferred embodiment, if a heat sensitive adhesive is used for the adhesive layer 146 of the metalized polymer film 140, then the one or both of the first mandrel 148 and second mandrel 150 can be heated.

It will be understood that several layers of the metalized polymer film 140 could be built up around the circumference of the seal bag 118 through continuous application of the metalized polymer film around the circumference of the seal bag 118. Multiple layers of metalized polymer film 140 provide more protection from handling of the seal bag 118 and the multiple polymer film layers 144 protect the thin metal film layers 142. It will be further understood that if a heat sensitive adhesive is used for the adhesive layer 146 of the metalized polymer film 140, then after the desired layers of metalized polymer film 140 are applied to the seal bag 118 of FIG. 5 or 6, an oven can be utilized to cure the adhesive.

Figure 7:
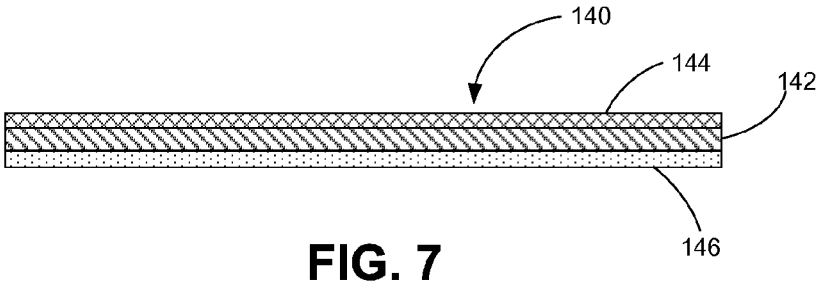
FIG. 7 is a cross-sectional view of a substrate constructed in accordance with an alternate preferred embodiment.

Turning to FIG. 7, shown therein is an alternate embodiment of the metalized polymer film 140. In the alternate embodiment depicted in FIG. 7, the metal coating layer 142 is located between the exterior polymer film layer 144 and the interior adhesive layer 146. Presently preferred metals to be used in the metal coating layer 142 include titanium, stainless steel, nickel, aluminum, chrome, silver and gold, and alloys for each of these metals. It will be appreciated that the metal coating layer 142 may be produced with combinations of multiple metals and metal alloys. It will also be understood that in alternate preferred embodiments, the metal coating layer 142 may consist of multilayered coatings with two or more metal coating layers 142 and that each metal coating layer 142 may be prepared using different metals and metal alloys.

Figure 8:
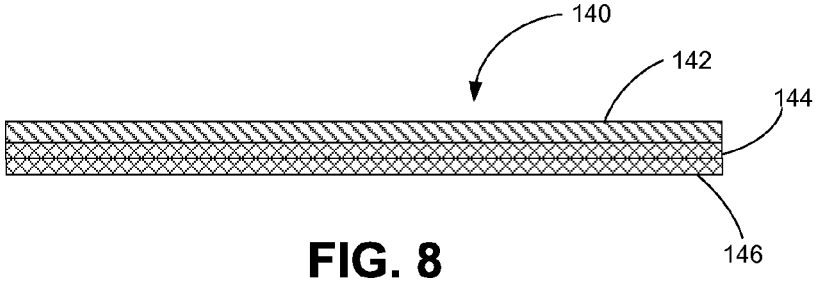
FIG. 8 is a cross-sectional view of a substrate constructed in accordance with an alternate preferred embodiment.

Turning to FIG. 8, shown therein is an alternate embodiment in which the adhesive layer 146 is manufactured from a heat-fusable polymer. Suitable polymers include PEEK, PTFE, and PVC. In a particularly preferred embodiment, the adhesive layer is manufactured from the same polymer used for the polymer film layer 144. During application to the seal bag 118, the application of heat to the adhesive layer 146 fuses the polymer in the adhesive layer 146 to the bag substrate 130.

Figure 9:
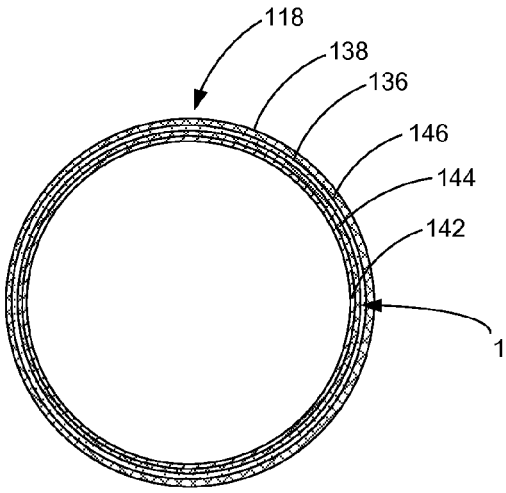
FIG. 9 is a cross-sectional view of a metalized polymer film applied to the interior of the seal bag.
Figure 10:
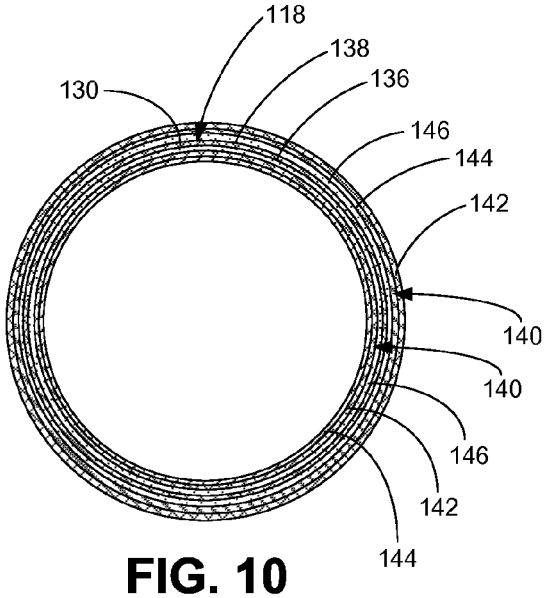
FIG. 10 is a cross-sectional view of a metalized polymer film applied to the interior and exterior of the seal bag.

Turning to FIG. 9, shown therein is yet another preferred embodiment in which the metalized polymer film 140 is applied to the interior surface 136 of the substrate 130. The metalized polymer film 140 can either be applied directly to the interior surface 136 of the substrate 130 or applied to the exterior surface 138 of the substrate and then turned inside-out to present the metalized polymer film 140 on the inside of the seal bag 118. In the preferred embodiment depicted in FIG. 10, the metalized polymer film 140 is applied to both interior surface 136 and the exterior surface 138 of the substrate using the manufacturing techniques disclosed herein. The interior metalized polymer film 140 has an external metal coating layer 142 and the exterior metalized polymer film 140 has an external polymer film layer. It will be appreciated the embodiment depicted in FIG. 10 is merely exemplary and that additional combinations and variations of the metalized polymer film 140 are within the scope of preferred embodiments.

The process of applying metalized polymer film 140 to the seal bag 118 reduces the risk of water permeation into the motor assembly 110, and protects high temperature motor insulation materials, reduces motor winding shorts, and provides better lubrication characteristics. It will be also be understood that the novel process of applying metalized polymers to PFA substrates will find application in other downhole components, including, for example, mechanical seal bellows and pothead connectors.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method for applying a metalized polymer film to a seal bag for use in a downhole submersible pumping system, wherein the seal bag is manufactured from a substrate, the method comprising the steps of:

applying a metal layer to a first planar side of a polymer layer;

applying an adhesive layer to a second planar side of the polymer layer; and rolling the adhesive layer onto the substrate of the seal bag.

2. The method of claim 1, wherein the metal layer comprises a metal selected from the group consisting of titanium, stainless steel, nickel, aluminum, chrome, silver and gold.

3. The method of claim 1, wherein the metal layer comprises at least two metals selected from the group consisting of titanium, stainless steel, nickel, aluminum, chrome, silver and gold.

4. The method of claim 1, wherein the polymer layer comprises a polytetrafluoroethylene polymer in a thickness ranging from 0.001 inches to about 0.005 inches.

5. The method of claim 1, further comprising the steps of:

rotating a first roller, wherein the first roller is located above the metal layer of the metalized polymer film; and rotating a second roller in the opposite direction of the first roller, wherein the second roller is located on an interior surface of the substrate of the seal bag.

6. The method of claim 5, further comprising the step of applying pressure with the first roller and the second roller to help the adhesive layer adhere to the substrate.

7. The method of claim 5, further comprising the step of applying heat to the first roller and the second roller to help the adhesive layer adhere to the substrate.

8. The method of claim 1, wherein the substrate has an interior and an exterior and the step of rolling the adhesive layer onto the substrate of the seal bag further comprises rolling the adhesive layer onto the exterior of the substrate.

9. The method of claim 1, wherein the substrate has an interior and an exterior and the step of rolling the adhesive layer onto the substrate of the seal bag further comprises rolling the adhesive layer onto the exterior of the substrate and then turning the substrate inside-out.

10. A method for applying a metalized polymer film to a seal bag for use in a downhole submersible pumping system, the method comprising the steps of:

applying a metal layer to a polymer layer;

applying an adhesive layer to the metal layer; and rolling the adhesive layer onto a substrate of the seal bag.

11. The method of claim 10, wherein the metal layer comprises a metal selected from the group consisting of titanium, stainless steel, nickel, aluminum, chrome, silver and gold.

12. The method of claim 10, wherein the metal layer comprises at least two metals selected from the group consisting of titanium, stainless steel, nickel, aluminum, chrome, silver and gold.

13. The method of claim 10, wherein the polymer layer comprises a polytetrafluoroethylene polymer in a thickness ranging from 0.001 inches to about 0.005 inches.

14. The method of claim 10, further comprising the steps of:

rotating a first roller, wherein the first roller is located above the polymer layer of the metalized polymer film; and rotating a second roller, in the opposite direction of the first roller, wherein the second roller is located on an interior surface of the substrate of the seal bag.

15. The method of claim 14, further comprising the step of applying pressure with the first roller and the second roller to help the adhesive layer adhere to the substrate.

16. The method of claim 14, further comprising the step of applying heat to the first roller and the second roller to help the adhesive layer adhere to the substrate.

* * * * *